United States Patent [19]

Caruso

[11] Patent Number: 4,603,706

[45] Date of Patent: Aug. 5, 1986

[54] HAIR CURLER

[76] Inventor: Richard Caruso, 7801 Montgomery Ave., Elkins Park, Pa. 19117

[21] Appl. No.: 471,981

[22] Filed: Mar. 4, 1983

[51] Int. Cl.[4] ..... A45D 2/26

[52] U.S. Cl. ..... 132/41; 132/40; 132/42

[58] Field of Search ..... 132/41, 40, 42, 39, 132/33 G

[56] References Cited

U.S. PATENT DOCUMENTS

| | | | |
|---|---|---|---|
| 1,652,356 | 12/1927 | Hammerly | 132/40 UX |
| 2,145,539 | 7/1939 | Bottorf | 132/41 |
| 2,156,687 | 5/1939 | Grabner | 132/33 R |
| 2,604,893 | 7/1952 | Hoipo | 132/40 |
| 2,657,694 | 11/1953 | Reed et al. | 132/41 R |
| 2,910,989 | 11/1959 | Russell | 132/40 |
| 3,572,350 | 3/1971 | Adams et al. | 132/39 |
| 3,759,271 | 9/1973 | Caruso | 132/33 G |
| 4,202,360 | 5/1980 | Walter | 132/40 |

FOREIGN PATENT DOCUMENTS

| | | | |
|---|---|---|---|
| 1027376 | 2/1954 | Fed. Rep. of Germany | 132/39 |

*Primary Examiner*—Gregory E. McNeill

*Attorney, Agent, or Firm*—Seidel, Gonda, Goldhammer & Abbott

[57] ABSTRACT

A hair curler for subjecting hair to steam to effect a curling action includes a hollow perforated core surrounded by a porous substrate. The core has circular extensions on each end which have a diameter greater than the diameter of the core. At lest one of the extensions is open at its end remote from the core and has an axial length which is substantially less than the length of the core.

17 Claims, 9 Drawing Figures

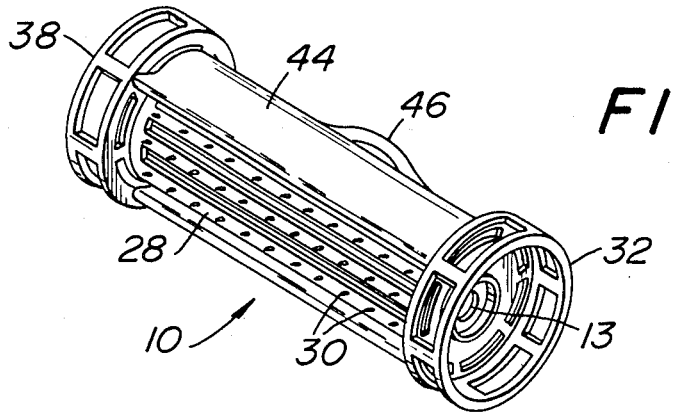
FIG. 1
FIG. 2
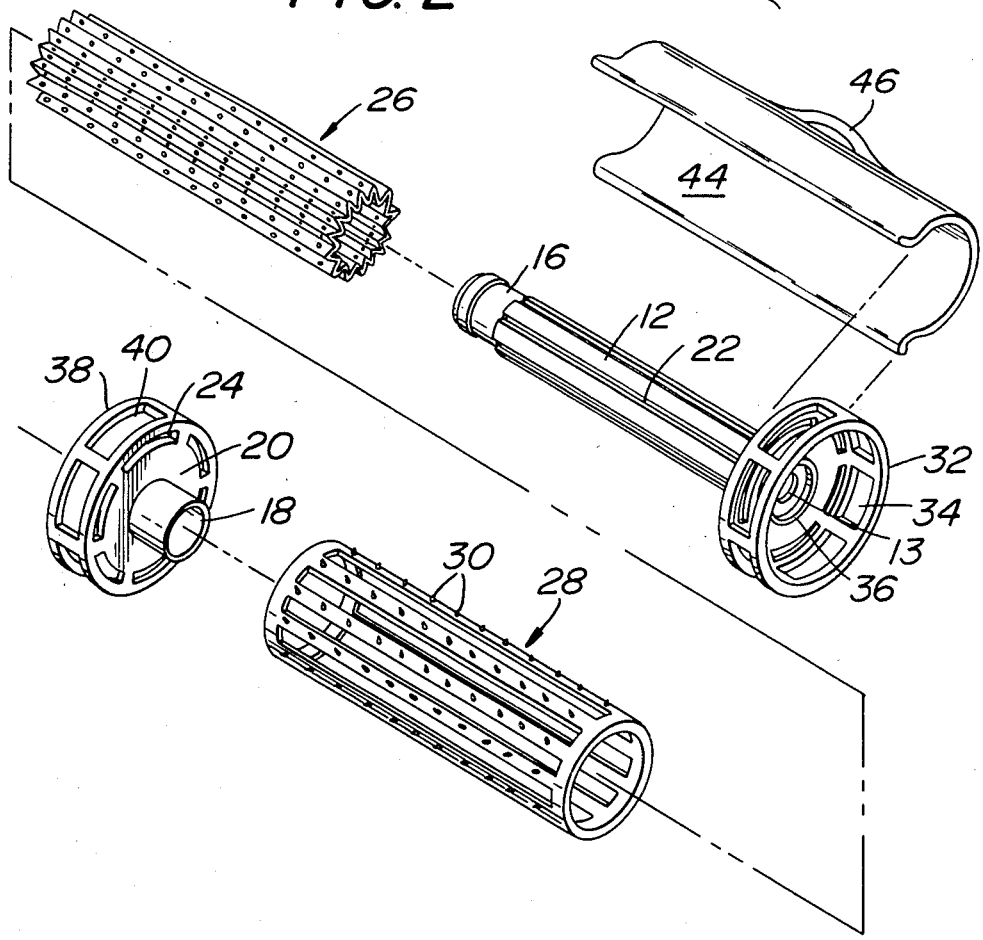

FIG. 3
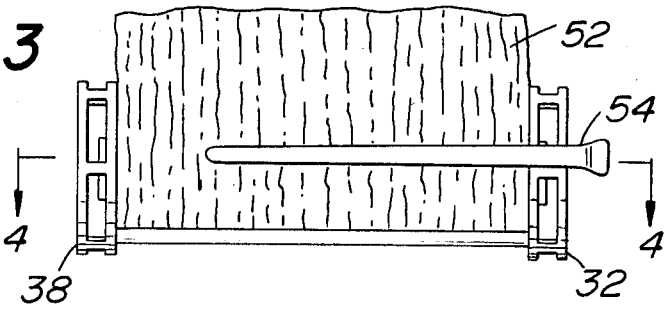
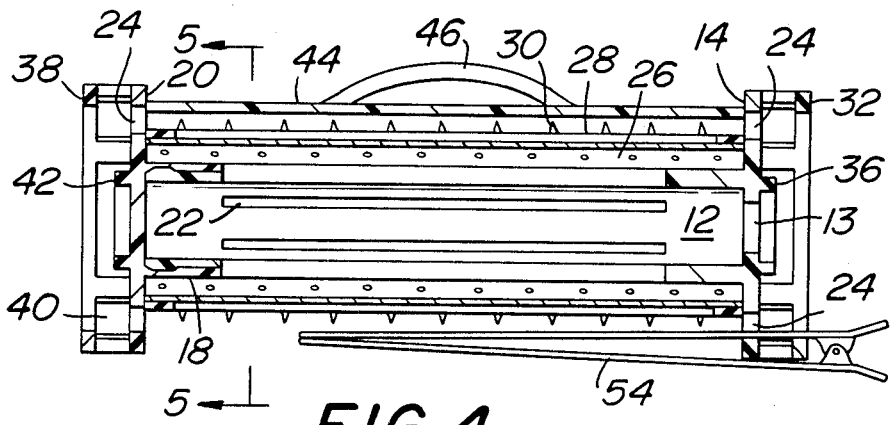
FIG. 4
FIG. 6
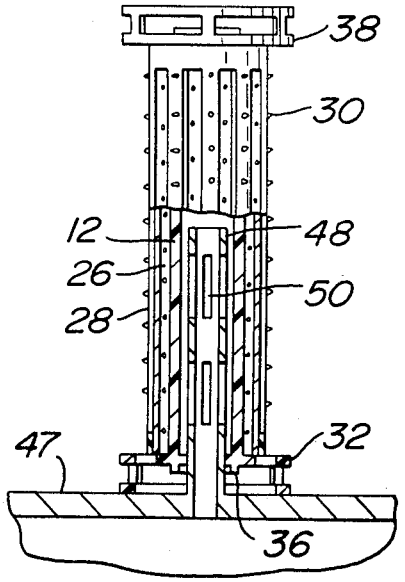
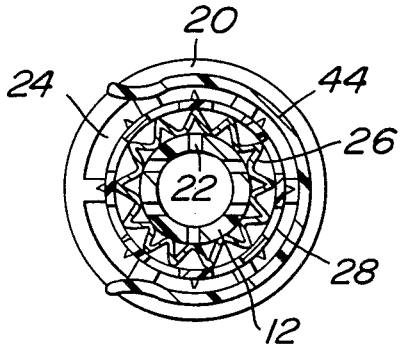
FIG. 5

FIG. 7
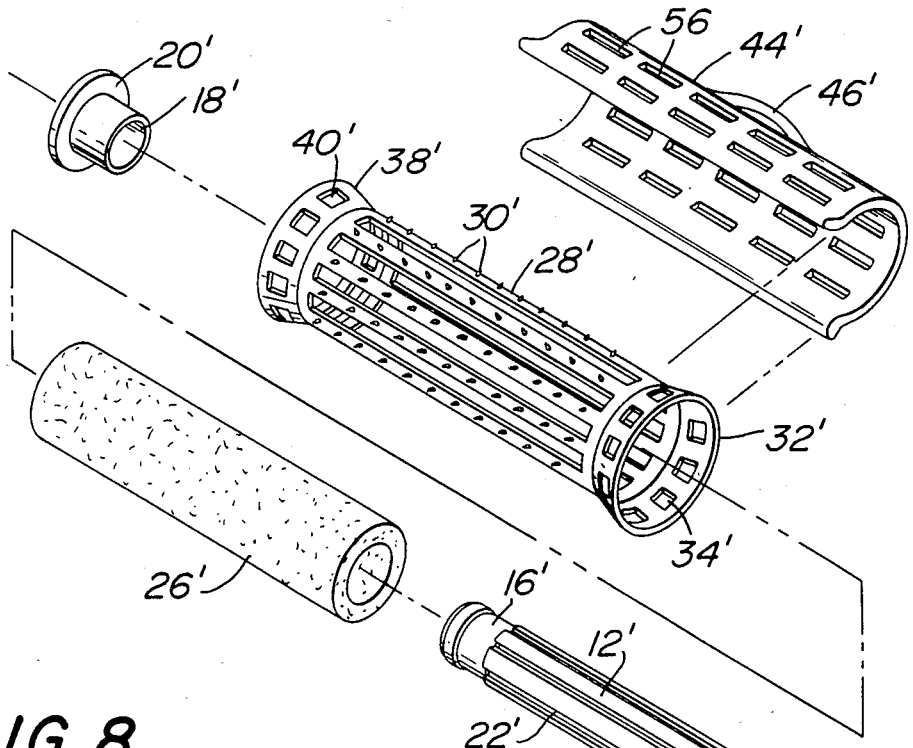
FIG. 8
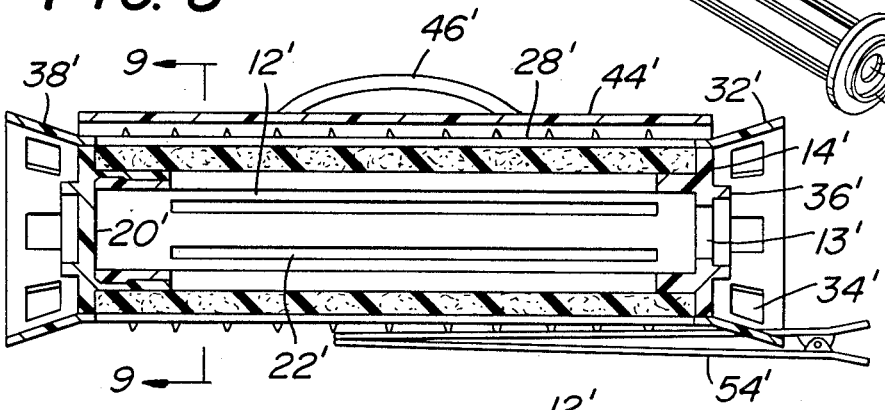
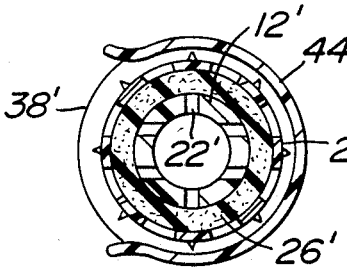
FIG. 9

HAIR CURLER

BACKGROUND OF THE INVENTION

Hair Curlers of the general type involved herein are known. See my U.S. Pat. No. 3,759,271 dated Sept. 18, 1973 and entitled Hair Curler. The present invention is directed to an improved hair curler which resolves a number of problems associated with the hair curler disclosed in said patent and which are only ascertainable after substantial experience with the use of said hair curler.

While the hair curler disclosed in said patent has been satisfactory, I have found a number of ways to make the hair curler superior and easier to use. The structural features involved will be described in greater detail hereinafter.

SUMMARY OF THE INVENTION

The present invention is directed to a hair curler adapted for use with steam. The hair curler includes a hollow perforated core. The core has an opening on one end through which steam can be introduced. A porous substrate surrounds the core. A circular extension is provided on each end of the core. The diameter of the extensions is greater than the diameter of the core. The extensions are coaxial with the core. One of the extensions is open at its end remote from the core. The axial length of said extensions being substantially less than the length of the core.

The present invention is directed to a hair curler for use with steam and is easy to manufacture as well as being easy to use.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a hair curler in accordance with the present invention.

FIG. 2 is an exploded view showing the components of the hair curler shown in FIG. 1.

FIG. 3 is a plan view showing the hair curler clipped to hair.

FIG. 4 is a longitudinal sectional view of the hair curler.

FIG. 5 is a sectional view taken along the line 5—5 in FIG. 4.

FIG. 6 is a vertical sectional view showing the hair curler mounted on a steamer.

FIG. 7 is an exploded view of a hair curler in accordance with another embodiment of the present invention.

FIG. 8 is a longitudinal sectional view of the hair curler shown on FIG. 7.

FIG. 9 is a sectional view taken along the line 9—9 in FIG. 8.

DETAILED DESCRIPTION

Referring to the drawing in detail, wherein like numerals indicte like elements, there is shown in FIG. 1 a hair curler in accordance with the present invention designated generally as 10. The hair curler 10 includes a core 12 integral at one end with a rim 14. The core 12 is hollow and has an inlet 13 at the end thereof attached to the rim 14. See FIG. 4.

The core 12 has a reduced diameter portion 16 which telescopically receives a hub 18. Hub 18 is connected to a rim 20. See FIG. 2. Rim 20 does not have a hole coaxial with the hub 18 as shown more clearly in FIG. 4.

The core 12 is perforated and that is preferably accomplished by providing a plurality of longitudinally extending slots 22 which terminate at the reduced diameter portion 16. Each of the rims 14, 20 has a plurality of arcuate slots 24. By making core 12 and rim 14 in one piece and hub 18 in rim 20 as a separate piece, manufacture of the roller is simplified. A tubular porous substrate 26 surrounds the core 12. Substrate 26 as shown is a corrugated material which is perforated so as to be highly porous. Substrate 26 may be made of plastic, impregnated paper, etc. Substrate 26 acts as a distributor of steam in axial and radial directions with respect to the core 12. The substrate 26 is telescoped over the core 12. Then hub 18 is snapped onto the reduced diameter portion 16 with a friction fit.

A casing 28 is telescoped over the substrate 26. Casing 28 has longitudinally extending slots with radially outwardly extending projections 30 on the strips between adjacent slots. Projections 30 facilitate intimate contact between the hair roller 10 and the hair to be wound therearound.

A circular extension 32 extends from one end of the core 12 and is coaxial therewith. The circular wall of extension 32 is preferably provided with openings 34. An annular boss 36 is coaxial with the inlet 12 and extends from the core 12 for an axial length less than that of the axial length of extension 32. Extension 32 acts as a spacer as will be made clear hereinafter.

At the end of the core 12 remote from extension 32, there is provided a comparable extension 38. The cylindrical wall of extension 38 has openings 40. Extensions 32 and 38 are each substantially shorter than the length of the core 12. Within the extension 38 there is provided a cylindrical boss 42 coaxial with the core 12. The purpose of bosses 36 and 42 will be made clear hereinafter.

A semi-circular shield may be provided to help retain steam within the hair curler 10. The shield 44 is open at each end and has a length such that its ends will be in frictional contact with the inner surface of the rims 14 and 20. Shield 44 is preferably provided with a handle 46 projecting radially outwardly therefrom to facilitate ease of manipulation of the shield.

Referring to FIG. 6, there is shown the top wall of a steamer 47 having a discharge nozzle 48. Nozzle 48 is open at the end thereof remote from the steamer top wall and also has longitudinally extending discharge slots 50. The nozzle 48 extends through the inlet 13 and terminates at approximately the mid-point of the curler 10. In this manner, the hair curler will be steamed in a much faster manner than prior art devices. The top wall of a steamer 47 supports the roller 10 while it is being steamed. Roller 10 may be steamed with or without the shield 44.

When the roller 10 is wrapped around hair 52, the hair 52 cooperates with the projections 30 to minimize unraveling. A clip 54 may be utilized to embrace opposite faces of the hair 52 and retain the hair curler in place. Clip 54 has on leg extending through the arcuate slot 24 on rim 14. The other leg of the clip 54 extends along the outer periphery of the extension 32.

In order to facilitate rapid removal of the hair curler 10, the handle 46 facilitates rapid removal of the shield 44. With a thumb in boss 42 and a fingertip in boss 36, the fingertips act as an axle for unwinding the curler 10 from the hair 52. As pressure is applied in an appropriate direction for removing the hair curler, the hair curler spins and unwinds itself from the hair 52.

In FIGS. 7–9 there is illustrated another embodiment of the present invention wherein the hair curler is designated generally as 10'. The hair curlers 10 and 10' are identical except as will be made clear hereinafter. Accordingly, corresponding elements are identified by corresponding prime numerals.

The substrate 26 is preferably a foam porous tubular material. The tubular extensions 32' and 38' are integral with the ends of the casing 28'. The diameter of the rims 14' and 20' is sufficient whereby they are telescoped inside the casing 28'. The extensions 32' and 38' are in the form of truncated cones with their maximum diameter portion being at their free ends. The shield 44' preferably has a plurality of longitudinally extending slots 56 which facilitate rapid drying of hair while the shield is in place around the curler 10' with hair between the curler and the shield.

The present invention may be embodied in other specific forms without departing from the spirit or essential attributes thereof and, accordingly, reference should be made to the appended claims, rather than to the foregoing specification, as indicating the scope of the invention.

I claim:

1. A hair curler comprising:

a tubular core having a plurality of slots axially disposed around a circumference of the core, the core being open at one end and closed at the other end;

a circular extension disposed at each end of the core, the extension having a diameter greater than the diameter of the core and being coaxial with the core, a length of the extension being substantially less than a length of the core;

a tubular porous substrate surrounding the core and being between the extensions and being in contact with the core; and a tubular casing having a plurality of slots axially disposed around a circumference of the casing, the slots terminating proximal ends of the casing, the casing surrounding the substrate between the extensions and being in contact with the substrate.

2. A hair curler in accordance with claim 1 wherein each of said extension has openings in a generally axial surface thereof.

3. A hair curler in accordance with claim 1 including an annular boss at each end of the core, each of said extensions having an axial length greater than the axial length of the bosses.

4. A hair curler in accordance with claim 1 including a generally semi-circular shield, said shield having a handle approximately equidistant from the free ends of the shield.

5. A hair curler in accordance with claim 4 wherein said shield has slots therethrough to facilitate passage of heated air for drying hair.

6. A hair curler in accordance with claim 1 wherein said tubular porous substrate is corrugated with the corrugations extending axially thereof.

7. A hair curler in accordance with claim 1 including means supporting said extensions is a rim extending radially from the ends of said core.

8. A hair curler in accordance with claim 1 including a source of steam, said source of steam having a hollow nozzle open at one end thereof, said nozzle having perforations along the length thereof, the diameter of said inlet being sufficient so that the nozzle may extend through said inlet, the length of said core and first extension being arranged so that the nozzle end terminates approximately equidistant from the ends of the core.

9. The hair curler according to claim 1 wherein said casing includes a plurality of axially disposed radially extending projections.

10. The hair curler according to claim 1 wherein each of said extensions is conical with the smaller diameter end thereof being adjacent the end of the core.

11. A hair curler comprising:

a tubular core having a plurality of slots axially disposed around a circumference of the core;

a rim located at each end of the core, each rim extending radially from the core and having a diameter greater than the core and being coaxial with the core, one rim having an opening which is coaxial with the core and having a diameter no greater than the core;

a circular extension located at a periphery of the rim and extending axially therefrom, an axially length of the extension being less than an axial length of the core;

a tubular porous substrate surrounding and in contact with the core and being disposed between the rims; and a tubular casing having a plurality of slots axially disposed around a circumference of the casing, the slots terminating proximal ends of the casing, the casing surrounding and being in contact with the substrate and being between said rims.

12. A hair curler in accordance with claim 11 including an annular boss at each end of the core, each of said extensions having an axial length greater than the axial length of the bosses.

13. A hair curler in accordance with claim 11 including a generally semi-circular shield, said shield having a handle approximately equidistant from the free ends of the shield.

14. A hair curler in accordance with claim 13 wherein said shield has slots therethrough to facilitate passage of heated air for drying hair.

15. A hair curler in accordance with claim 11 wherein said tubular porous substrate is corrugated with the corrugations extending axially thereof.

16. A hair curler in accordance with claim 11 wherein said means supporting said extensions is a rim extending radially from the ends of said core.

17. A hair curler in accordance with claim 11 wherein said extensions are supported by a casing surrounding the substrate.

* * * * *